United States Patent [19]

Lee

[11] Patent Number: 4,607,458

[45] Date of Patent: Aug. 26, 1986

[54] VERY HIGH SPEED LAP WITH NEGATIVE LIFT EFFECT

[75] Inventor: Roger K. Lee, Watertown, Mass.

[73] Assignee: The United States of America as represented by the Secretary of the Air Force, Washington, D.C.

[21] Appl. No.: 720,936

[22] Filed: Apr. 8, 1985

[51] Int. Cl.[4] ..... B24B 7/00

[52] U.S. Cl. ..... 51/119; 51/209 R; 51/283 R

[58] Field of Search ..... 51/71, 109 R, 119, 125, 51/209 R, 209 DL, 283 R, 330, DIG. 6; 29/81 R, 81 G, 81 J; 125/5

[56] References Cited

U.S. PATENT DOCUMENTS

| | | | |
|---|---|---|---|
| 843,624 | 2/1907 | Peirce . | |
| 1,979,689 | 11/1934 | Hoke | 51/278 |
| 2,065,942 | 12/1936 | Lane | 51/209 R |
| 2,270,691 | 1/1942 | Schneider | 51/209 |
| 2,412,306 | 12/1946 | Stoll | 51/119 |
| 2,776,527 | 1/1957 | Hoyet et al. | 51/209 DL |
| 2,820,334 | 1/1958 | Touvay | 51/209 |
| 4,019,289 | 4/1977 | Korver | 51/395 |

FOREIGN PATENT DOCUMENTS

| | | | |
|---|---|---|---|
| 59360 | 9/1982 | European Pat. Off. | 51/109 R |
| 2659438 | 7/1978 | Fed. Rep. of Germany | 51/209 R |
| 127657 | 8/1982 | Japan | 51/283 R |
| 422571 | 9/1974 | U.S.S.R. | 51/209 R |
| 1009724 | 4/1983 | U.S.S.R. | 51/283 R |

*Primary Examiner*—Robert P. Olszewski

*Attorney, Agent, or Firm*—Donald J. Singer; William G. Auton

[57] ABSTRACT

A rotary lapping system which contains a construction and mounting of grinding pads called tesserae which act to produce a negative lift or suction through hydrodynamic action with an abrasive slurry liquid is disclosed. The rotary lapping system uses a plurality of negative lift tools, each of which is composed of a square base of metal, a rubber sheet bonded to the base and four brass tessera bonded to the rubber sheet. Each tessera has a plurality of equally spaced, parallel grooves forming the grinding surface and the four tesserae are bonded to the rubber sheet to leave a relatively wide space, or slot, between each of the tessera. Four negative lift tools are attached around the outer edge of a metal ring, equally spaced, and the metal ring is bonded to a rubber ring which is bonded to the base of a power driven dish-like member for hodding a grinding slurry to be fed to the grinding surfaces. The tessera construction causes a negative lift, or suction, to produce very strong cutting pressure with more rapid material removal without distortion of, or harm to the workpiece. The negative lift is the result of the particular mounting of the tesserae, which cause the tesserae at the leading edge of the rubber sheet to present a negative angle of attack to the abrasive slurry liquid during rotation.

6 Claims, 8 Drawing Figures

5-MICROMETER PARTICLE GRIND-ETCHED 1.5-MICROMETER PARTICLE GRIND-ETCHED

VERY HIGH SPEED LAP WITH NEGATIVE LIFT EFFECT

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to abraiding through the use of rotary lapping systems, and is specifically directed to the use and configuration of grinding pads, called tesserae, which produce a negative lift effect in high speed lap grinding.

Rotary lapping systems are used to remove material from a variety of types of workpieces. These workpieces include large lightweight, odd-shaped, infrared quality aspheric mirrors, and other optical elements, which are manufactured through a succession of grinding and polishing with rotary lapping systems.

A review of optical surfacing techniques indicates that two-thirds of the manufacturing time is spent polishing out subsurface damage from grinding. The lightweight optical elements and mirrors of orbiting telescopes will be extremely thin (e.g., 3 mm) and aspheric with changing surface curvature. The use of very thin glass sections limits the use of grinding and polishing pressures, yet there exists a need to process large sections of aspheric optical systems in a rapid and efficient manner, while avoiding deformation of the optical surface of the workpiece. While optical surface tolerances are less difficult to meet in infrared systems, eventually the next generation of space telesopes will require quality suitability for visible-spectrum use.

In view of the foregoing discussion it is apparent that there currently exists the need for a rotary lapping system capable of generating strong cutting pressures between the tool and the workpiece, while placing no net downward force on the workpiece. The present invention is directed towards satisfying that need.

SUMMARY OF THE INVENTION

The present invention relates to abraiding and is specifically directed to the construction of grinding pads called tesserae to produce a negative lift effect in high speed lap grinding. Each pad is composed of a square base of metal, a rubber sheet bonded to the base and four brass tessera bonded to the rubber sheet. Each tessera has a plurality of equally spaced, parallel grooves forming the grinding surface and the four tesserae are bonded to the rubber sheet to leave a relatively wide space, or slot, between each of the tessera. The four pads are attached around the outer edge of a metal ring which is bonded to the base of a power driven dish-like member for holding a grinding slurry to be fed to the grinding surfaces. The tessera construction causes a negative lift, or suction, to produce very strong cutting pressure with more rapid material removal without distortion of, or harm to the workpiece.

It is a principal object of the invention to present a rotary lapping system capable of grinding and polishing thin, aspheric workpieces in a rapid and efficient manner.

It is another object of the present invention to minimize subsurface damage when grinding thin workpieces.

It is another object of the present invention to present a rotary lapping system which produces a negative lift, or suction between the tool and workpiece, which enables the generation of strong cutting pressures without the need for strong downward pressures on the workpiece.

These together with other objects features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention includes the configuration and use of grinding pads called tesserae, which produce a negative lift effect in high speed lap grinding.

Figure 1:
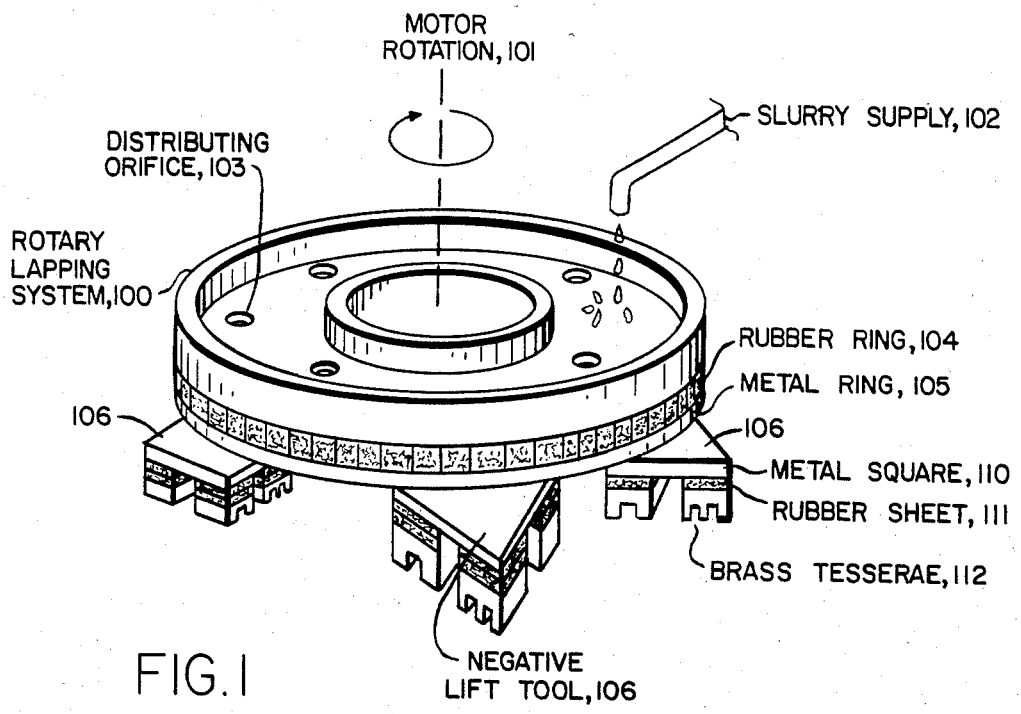
FIG. 1 is a sketch of the rotary lapping system of the present invention.

FIG. 1 is a block diagram of a rotary lapping system 100, of the present invention, which removes material from workpiece using a liquid abrasive slurry. The rotary lapping system 100 is used to grind or polish workpieces using a motor rotation 101 and liquid abrasive slurry from a slurry supply 102.

In the embodiment depicted in FIG. 1, the liquid abrasive slurry falls on the surface of the workpiece through a plurality of distributing orifices 103. The grinding is accomplished by the movement of a plurality of negative lift tools 106, each of which are equally spaced from each other, and attached around the outer edge of a metal ring 105, which is fixed to a rubber ring 104 which is bonded to the base of the power driven dish-like member of the rotary lapping sytem.

Figure 2A:
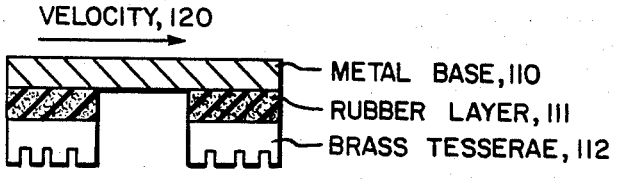
FIGS. 2*a* and 2*b* are two views of the negative lift tools of the present invention.
Figure 2:
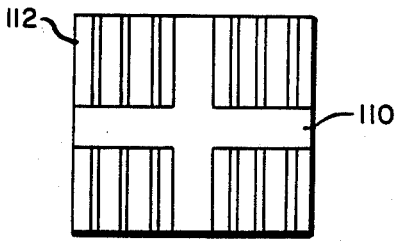

FIGS. 2*a* and 2*b* are alternative perspective views of a single negative lift tool 106 of FIG. 1. The configuration of the lap tesserae mounting in each negative lift tool 106 is responsible for the strong negative lift or suction created with the use of the present invention.

FIGS. 2*a* and 2*b* depict four brass tesserae 112, each bonded to a rubber layer 111, which has the same surface area as its respective tesserae 112. Each rubber layer or pad 111 is, in turn, bonded to the single square base of metal 110 which is fixed to the metal ring 105 of the rotary lapping system 100 of FIG. 1.

Each tesserae has a plurality of equally spaced, parallel grooves forming its grinding surface, but it is the configuration of the lap tesserae mounting that is responsible for the production of the negative lift when using the invention. The particular configuration of the lap tesserae mounting causes each particular tesserae to present a negative angle of attack when rotated in the abrasive slurry liquid. The hydrodynamic action of this negative angle of attack in the abrasive slurry liquid produces the negative lift experienced by each of the tesserae. A discussion of a particular example of the lap tesserae mounting follows.

In the configuration depicted in FIGS. 2*a* and 2*b*, each of the rubber pads 111 leave a relatively wide space, or slot, between each of the tesserae 112. The negative lift or suction effect is obtained by mounting each tesserae 112 on soft rubber block 111 whose boundary is unconfined on all four sides, thus leading to an unstable type of slider bearing which will not support a load, and which with a normal fluid film would immediately collapse. However, because there are abrasive particles in the interface between the tesserae and the workpiece a powerful cutting action is obtained.

Figure 3:
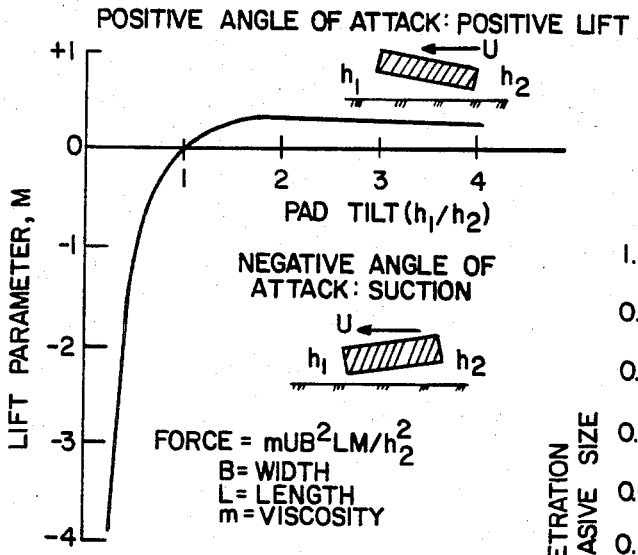
FIG. 3 is a chart depicting the performance of a tilting pad bearing.

FIG. 3 is a chart depicting the performance of a tilting pad bearing. FIG. 3 indicates the entire response of a tilting pad, such as the tesserae 112 of FIGS. 2*a* and 2*b*, for both positive and negative angles of attack.

The tesserae mounting configuration shown in FIGS. 2*a* and 2*b* produce a negative angle of attack when each tesserae 112 is moved with the velocity 120 during rotary lapping. FIG. 3 indicates that with the negative angle of attack, the suction forces are more intense than the lifting forces in this system.

In another application by the present inventor entitled "High Speed Lap with Positive Life Effect", U.S. Ser. No. 720,937, filed April 8, 1985, FIG. 3 is used to describe how a different configuration of lap tesserae mounting produces a positive angle of attack and positive lift.

In the present invention, the lap tesserae mounting results in the creation of a strong negative pressure or suction under the tesserae which greatly increases the pressure of the tool on the abrasive slurry particles between the tool and the workpiece. The advantage of this approach is that very strong cutting pressures can be generated between the tool and the work, while there is no net downward force on the workpiece; therefore, especially for thin workpieces there is little or no tendency for the nature of the workpiece structure to affect the optical figure or shape of the surface being lapped. This system allows one to rapidly remove material from very thin (e.g., 3 mm) pieces without deformation.

In the preferred embodiment, the slurry type used with this tool consists of 0.1 percent polyethylene oxide ($4\times10^6$ molecular weight), 2 percent of 1 to 2 micrometer diamond powder, 1 percent water soluble oil, and balance of distilled water; the linear speed of the tessarae is about 6.6 inches per second.

The selection of the above slurry type was made after empirically determining relative abrasive removal rates using a 12-pound ring tool of 75 square inches running at 120 RPM.

Figure 4:
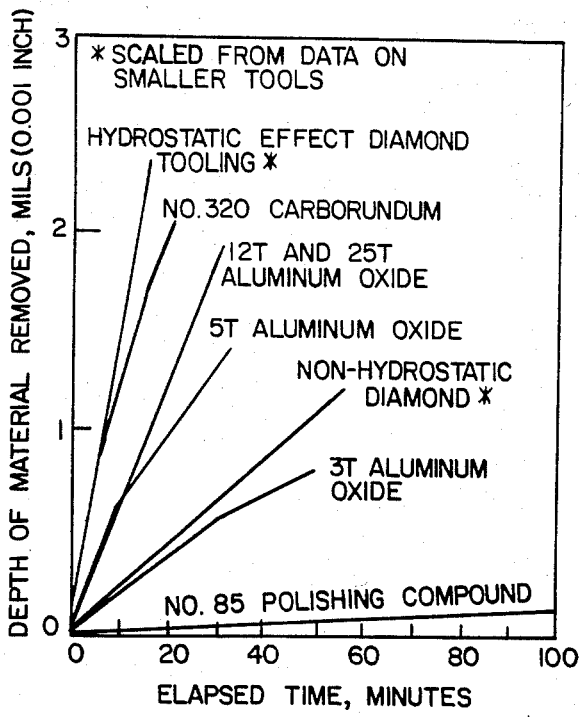
FIG. 4 is a chart depicting relative abrasive removal rates.

Data was collected using a Pyrex-faced rotating lap on Pyrex and fused silica blanks. Typical results are shown in FIG. 4. The cause of the slowness of the polishing operation becomes evident from these grinding rate curves; the finest abrasive it was found that one could use in this system was 5T aluminum oxide. The 3T aluminum oxide was tried, but produced a poor surface finish with sleeks and scratches, confirming normal optical workshop experience. To remove the damaged layer produced by 5T aluminum oxide abrasive, it would be necessary to polish away about $0.6\times10^{-3}$ inch of material. Because of missing useful abrasive particle sizes, the relatively ineffective operation was prolonged. Aluminum oxide particle strength decreases with particle size, becoming weaker than fused silica at around the 3-micrometer diameter. In order to get a useful smaller abrasive particle, one would need one that was stronger, like silicon carbide or diamond. After a brief study of different sources for abrasives, it was determined that synthetic diamonds were the cheapest and most sonsistently graded for size.

Figure 5:
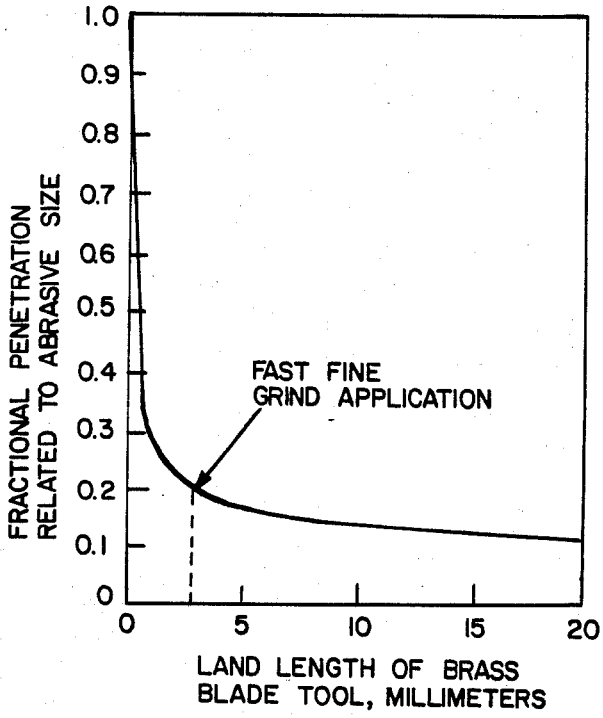
FIG. 5 is a chart depicting tool land versus fractional penetration or debris size as a fraction of the abrasive particle size for 2 micrometer size diamonds.

A seizing effect occurs when the interface between the lapping tool and the workpiece becomes clogged with swarf from the grinding operation. The seizing effect, suggests that one could compute the rate at which the tool-to-work interface filled up with swarf, and that the land length of the tool could be adjusted to that it was less than the path of travel needed to clog the tool. Assuming that the diamonds were 2.0 micrometer tetrahedrons rolling in the interface, the land length could be related to two parameters—the initial diamond concentration and the size of the debris particle produced. FIG. 5 shows the result of such an estimate using a typical diamond concentration soution of 5 percent; the land length is plotted against the debris size expressed as a fraction of the size of the abrasive particle, which by experience seems to be relatively constant for abrasive processes. By inference, for simple farctures, this fraction should be comparable to the depth of surface finish as well. Therefore, by measurement of the surface profiles, this fraction was found to be about 0.2, giving a land length of 4 millimeters. The tapered-form tools were accordingly slotted in the axial direction at a 4-millimeter pitch, and the resulting surface finishes were dramatically improved. Furthermore, in spite of the unidirectional tool motion, the surfaces produces were completely random in surface texture on a microscopic scale, being as perfectly found as any conventionally produced ground surface.

Figure 6A:
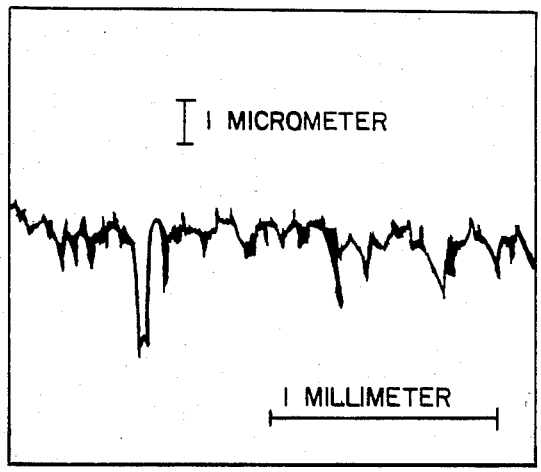
FIGS. 6*a* and 6*b* depict a comparison of 5 micrometer, and 1.5 micrometer particle grinds.
Figure 6B:
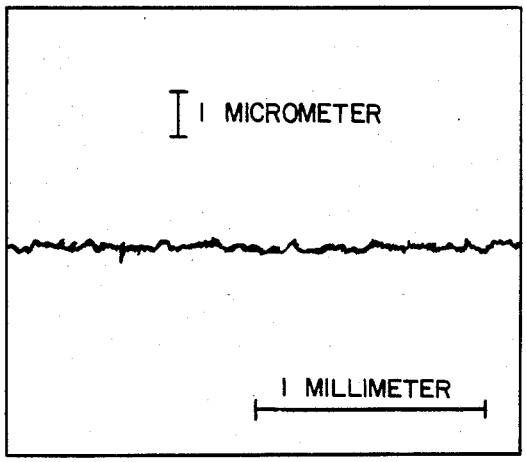

FIGS. 6*a* and 6*b* show the resulting surface finishes for 5-micrometer and 1,5-micrometer abrasives. The graph is a trace from the Dektac instrument from surfaces that have been etched to reveal their extent of subsurface damage. This type of ground surface has been characterized at Itek by the catch name "fast fine grind". The surface is sufficiently fine so that good contrast interference fringes can be obtained from it, thus facilitating optical testing without needing to use waxing or long-wavelength interferometers.

The preferred embodiment of the present invention entails its use with another invention that was developed in conjunction with it. This other invention is entitled "Computer Controlled Optical Surfacing (CCOS) Lap Pressure Control Concept" by Allen H. Greenleaf, the U.S. Ser. No. 777,141, filed Sept. 18, 1985, and the disclosure of which is incorporated herein by reference.

The Greenleaf invention combines the present invention with a means of controlling lap pressure, including the application of moments to the lapping pads. On the Greenleaf invention, each pad has an upwardly extending stem mounted in a slot or notch, in a rotary control plate by springs that cause tipping of the pads to produce the desired hydrodynamic effect.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A rotary lapping system capable of grinding and polishing a workpiece using an abrasive slurry liquid, said rotary lapping system generating strong cutting pressures without a need for strong downward pressures on the workpiece by generating a negative lift and suction between it and the workpiece through hydrodynamic action which generates the negative lift in the abrasive slurry liquid, said rotary lapping system comprising:

a supply of the abrasive slurry liquid, which is applied to the workpiece;

a rotary means;

a dish member being rotated by said rotary means; and a plurality of negative lift tools, each fixed beneath an outer edge of said disk member and producing said negative lift by presenting a surface with a negative angle of attack in said abrasive slurry liquid, each of said plurality of negative lift tools presenting a grinding surface to said workpiece which, when rotated in said abrasive slurry liquid from said supply, is used to grind said workpiece.

2. A rotary lapping system, as defined in claim 1, wherein each of said plurality of negative lift tools comprises:

a base which is fixed beneath the outer edge of the dish member;

a plurality of tesserae, each presenting a grinding surface towards the workpiece and a negative angle of attack in said abrasive slurry liquid when said negative lift tool is rotated, said negative angle of attack causing said negative lift; and a flexible mounting means which attaches each of said plurality of tesserae to the base, said flexible mounting means flexing to cause each tesserae to present a negative angle of attack in said abrasive slurry liquid when said negative lift tool is rotated.

3. A rotary lapping system, as defined in claim 2, wherein each of said plurality of tesserae comprises a rectangular metal block backing or plurality of equally spaced, parallel grooves forming its guiding surface at its bottom area, each of said plurality of tesserae having its top attached to said flexible mounting means.

4. A rotary lapping system, as defined in claim 3, wherein each of said flexible mounting means comprises a rubber pad which has the same surface area as the top of its respective tesserae, said rubber pad having its bottom surface bonded to the top of its respective tesserae, said rubber pad having its top surface bonded to said base, which is in turn, fixed beneath the outer edge of the dish member of the rotary lapping system.

5. A rotary lapping system, as defined in claim 4, wherein said dish member comprises:

a dish being rotated by said rotating means, said dish having a plurality of distributed apertures which distributes the abrasive slurry liquid, received from said supply, to the workpiece;

a rubber ring attached to the bottom of said dish; and a metal ring attached to the bottom of said rubber ring with each base of each of said plurality of negative lift tools being fixed beneath the outer edge of said metal ring.

6. A rotary lapping system, as defined in claim 5, wherein each of the negative lift tools are placed beneath the outer edge of said metal ring with equal amounts of space separating each of the negative lift tools from each other, each of the negative lift tools having one of said plurality of distributed apertures in the space separating the negative lift tools, each of the negative lift tools having its plurality of equally spaced, parallel grooves of its grinding surface in a position which is approximately perpendicular to the tangent of said metal ring at the point where said negative lift tool is fixed to said metal ring.

* * * * *